US006342781B1

(12) United States Patent
Laraia

(10) Patent No.: US 6,342,781 B1
(45) Date of Patent: Jan. 29, 2002

(54) CIRCUITS AND METHODS FOR PROVIDING A BANDGAP VOLTAGE REFERENCE USING COMPOSITE RESISTORS

(75) Inventor: J. Marcos Laraia, Pocatello, ID (US)

(73) Assignee: AMI Semiconductor, Inc., Pocatello, ID (US)

( * ) Notice: Subject to any disclaimer, the term of this patent is extended or adjusted under 35 U.S.C. 154(b) by 0 days.

(21) Appl. No.: 09/834,709

(22) Filed: Apr. 13, 2001

(51) Int. Cl.[7] ..... G05F 3/16
(52) U.S. Cl. ..... 323/313; 323/315; 327/543
(58) Field of Search ..... 323/312, 313, 323/314, 315; 327/538, 539, 540, 541, 542, 543

(56) References Cited

U.S. PATENT DOCUMENTS

| | | | | |
|---|---|---|---|---|
| 4,342,926 A | | 8/1982 | Whatley | 307/297 |
| 4,450,367 A | | 5/1984 | Whatley | 307/297 |
| 4,461,991 A | | 7/1984 | Smith | 323/312 |
| 4,890,052 A | | 12/1989 | Hellums | 323/315 |
| 4,935,690 A | | 6/1990 | Yan | 323/314 |
| 5,144,223 A | | 9/1992 | Gillingham | 323/313 |
| 5,155,384 A | | 10/1992 | Ruetz | 307/296.8 |
| 5,180,966 A | * | 1/1993 | Sugawara et al. | 323/315 X |
| 5,432,432 A | | 7/1995 | Kimura | 323/313 |
| 5,859,560 A | | 1/1999 | Matthews | 327/513 |
| 5,889,394 A | | 3/1999 | Czarnocki | 323/313 |
| 6,087,820 A | | 7/2000 | Houghton et al. | 323/315 |

* cited by examiner

*Primary Examiner*—Jessica Han
(74) *Attorney, Agent, or Firm*—Workman, Nydegger & Seeley

(57) ABSTRACT

A bandgap voltage reference circuit includes a current source and a bipolar transistor that are coupled together such that current from the current source passes through the bipolar transistor to a low voltage source such as ground. A composite resistor is coupled in series between the current source and the bipolar transistor. The composite resistor of this voltage reference leg of the circuit is composed of at least two component resistors that may be fabricated so as to adjust the temperature coefficient of the bandgap voltage reference as a whole.

14 Claims, 4 Drawing Sheets

CIRCUITS AND METHODS FOR PROVIDING A BANDGAP VOLTAGE REFERENCE USING COMPOSITE RESISTORS

CROSS-REFERENCE TO RELATED APPLICATIONS

The present application is related to commonly-owned co-pending application Ser. No. 09/834,421 entitled "CIRCUITS AND METHODS FOR PROVIDING A CURRENT REFERENCE WITH A CONTROLLED TEMPERATURE COEFFICIENT USING A SERIES COMPOSITE RESISTOR" filed on the same data herewith, which application is incorporated by reference in its entirety.

BACKGROUND OF THE INVENTION

1. The Field of the Invention

The present invention relates to the field of bandgap voltage reference circuits. In particular, the present invention relates to circuits and methods for providing a bandgap voltage reference using a series composite resistor and without requiring the use of an operational amplifier.

2. Background and Related Art

The accuracy of circuits often depends on access to a stable bandgap voltage reference. Accordingly, numerous bandgap voltage reference circuits have been developed. Typically, conventional bandgap voltage reference circuits require an operational amplifier. However, operational amplifiers are often a significant source of error due to their intrinsic offset voltage. Accordingly, bandgap voltage reference circuits that use operational amplifiers may be too inaccurate for some applications.

Some conventional bandgap voltage reference circuits correct for this error by using more elaborate operational amplifiers with low offset voltage or fairly complex circuitry to minimize the effect of the operational amplifier offset voltage. While such circuits do indeed provide fairly accurate bandgap reference voltages, these circuits are larger due to the operational amplifier and associated correcting circuitry. Thus, these circuits may occupy significant chip real estate. In addition, these circuits may also be costly to fabricate and have higher power requirements due to the complex design.

Accordingly, what is desired is a bandgap voltage reference circuit that is small, yet accurate, and that is suitable for low power applications.

SUMMARY OF THE INVENTION

In accordance with the present invention, what is described is the structure and operation of a circuit that provides a stable bandgap voltage reference. The circuit provides an accurate bandgap voltage reference without using an operational amplifier. Thus, the use of an elaborate low-offset operational amplifier or a complex correcting circuit normally associated with standard operational amplifiers is also avoided. Surprisingly, this is accomplished by using a composite resistor in both a current source and a voltage reference leg of the bandgap voltage reference circuit. As this result is far from obvious, the description includes a detailed proof illustrating why such a circuit does indeed result in an accurate bandgap reference voltage.

The bandgap voltage reference circuit includes a current source and a bipolar transistor that are coupled together such that current from the current source passes through the bipolar transistor to a low voltage source such as ground. A composite resistor is coupled in series between the current source and the bipolar transistor. The composite resistor of this voltage reference leg of the circuit is composed of at least two component resistors. Each resistor may be fabricated using standard CMOS processes so that the temperature coefficient of the composite resistor as a whole may be customized to the operating conditions of the bandgap voltage reference circuit. In one embodiment, the component resistors are coupled in series between the current source and the bipolar transistor.

The temperature coefficient of the composite resistor may be designed so as to generate a stable bandgap voltage reference for temperature variations within the operating range of the circuit. Accordingly, the circuit also provides a bandgap voltage reference that is relatively stable with normal supply voltage fluctuations.

The current source includes a relatively high voltage source and a relatively low voltage source. The current source includes two potential current paths from the high voltage source to the low voltage source. These potential paths are called a reference leg and a mirror leg. The reference leg includes a number of MOS transistors coupled in series between the high voltage source and the low voltage source. The MOS transistors include a group of at least one PMOS transistor that is electrically closer in the series to the high voltage source. The MOS transistors also include a group of at least one NMOS transistor that is electrically closer in the series to the second voltage source. The reference leg also includes a series composite resistor that includes at least two component resistors that are coupled in series with each other between the high and low voltage sources. The series composite resistor is disposed on either side of the plurality of MOS transistors in series between the high and low voltage sources. The mirror leg is coupled with the reference leg so that current flowing through the reference leg is mirrored in the mirror leg.

If a PNP bipolar transistor is implemented in each of the mirror leg and the reference leg in the current source, then the PMOS transistors define a current mirror while the NMOS transistors share a common gate voltage. If an NPN bipolar transistor is implemented in each of the mirror leg and the reference leg, then the NMOS transistors define a current mirror while the PMOS transistors share a common gate voltage.

This current source provides a current that is relatively stable with supply voltage fluctuations. This allows the bandgap voltage reference circuit as a whole to provide a bandgap voltage reference that is relatively stable with supply voltage fluctuations.

In one example, the composite resistor in the bandgap voltage reference leg of the circuit is a series composite resistor that is matched to the series composite resistor in the current source. For a given set of parameters, this provides a bandgap voltage reference of approximately 1.23 Volts with a downside curvature with temperature. However, this is by no means the only possible configuration for the composite resistor in the bandgap voltage reference leg. For example, by changing the temperature coefficient of the composite resistor at the bandgap voltage reference leg (by changing the size or configuration of the component resistors), the bandgap voltage reference may provide a different voltage with an upside curvature with temperature for the same CMOS process. In addition, the temperature coefficient of the composite resistors may be adjusted to offset first and second order variation of the bandgap voltage reference. This adjustment is often referred to as curvature correction.

The bandgap voltage reference circuit in accordance with the present invention has significant space advantages in that it builds upon an already useful circuit, the current source. The current source provides a current that is substantially stable with the temperature and may be useful for any circuit that requires a current reference. However, as will be explained in further detail in the following description, a reliable and accurate voltage reference circuit may be constructed by adding just two MOS transistors, a bipolar transistor and a composite resistor to the current source.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present invention relates to circuits and methods for providing an accurate bandgap voltage reference that is relatively stable with supply voltage fluctuations, and that does not require an operational amplifier. Although specific circuits are described herein, those skilled in the art will recognize, given the teaching of this description, that various modifications and additions may also be made that will implement the principles of the present invention. It is intended that the present invention embrace all such modifications and additions.

Figure 1:
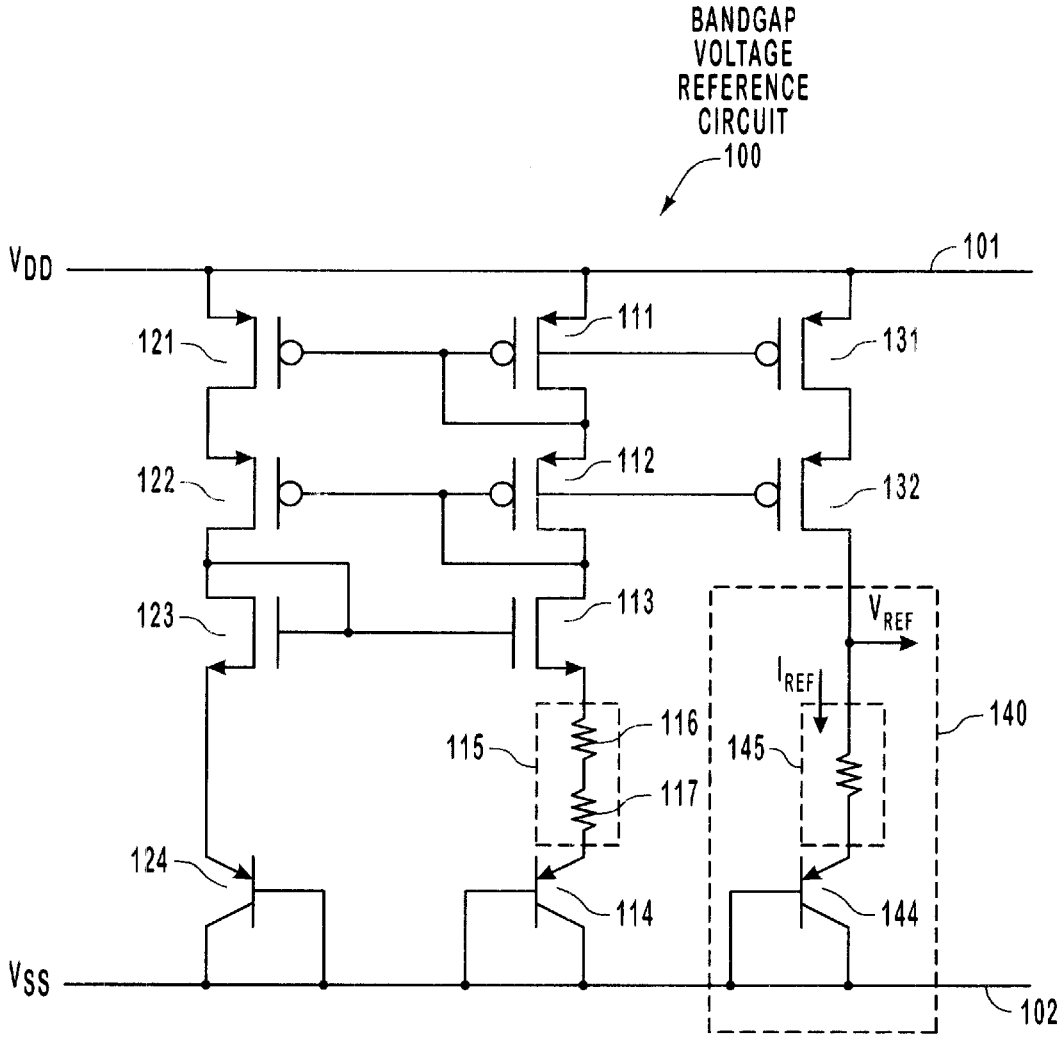
FIG. 1 illustrates a bandgap voltage reference circuit in the PNP configuration in accordance with the present invention.
Figure 2:
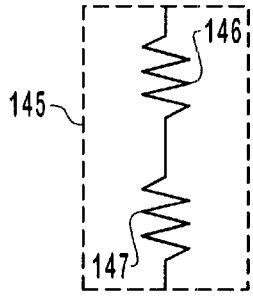
FIG. 2 illustrates a series configuration of the composite resistor of FIG. 1.

FIG. 1 illustrates an embodiment of a bandgap voltage reference circuit 100 in accordance with the present invention. The bandgap voltage reference circuit 100 comprises a current source which is represented by all the circuitry of FIG. 1 outside of the dashed box 140. The portion of the bandgap voltage reference circuit 100 within the dashed box 140 includes a PNP bipolar transistor 144 that has its base and collector terminal coupled to a low voltage source 102 (the collector terminal may also be coupled to a voltage lower that the low voltage source 102 without affecting the performance of the circuit). A composite resistor 145 is coupled between the current source and the bipolar transistor 144. As illustrated in FIG. 2, the composite resistor 145 may be a series composite resistor that includes two or more component resistors such as resistor 146 and resistor 147. By using a composite resistor, the component resistors may be fabricated using standard CMOS processes without requiring any special customized steps.

The bandgap voltage reference circuit 100 includes voltage sources 101 and 102, which may be, for example, voltage rails. The voltage source 101 is configured, during operation, to carry a higher voltage that the voltage source 102. Accordingly, voltage source 101 will often be referred to as "high" voltage source 101, while voltage source 102 will often be referred to as "low" voltage source 102. For example, during operation voltage source 101 carries a voltage $V_{DD}$, while voltage source 102 carries a voltage $V_{SS}$ (e.g., ground). The current source provides a stable reference current despite fluctuations in $V_{DD}$.

First, the current source will be described followed by a description of the remainder of the bandgap voltage reference circuit 100. Then, the operation of the bandgap voltage reference circuit will be described using a detailed proof to show that a bandgap voltage reference that is stable with temperature may be provided assuming that the configuration and resistor size ratios of the composite resistor 145 within the dashed box 140 is the same as the configuration and resistor size ratios of the composite resistor 115 in the current source. In conclusion, it will be shown that the configuration of the composite resistor 145 may be varied from this assumption to reduce first and second order temperature variations, and thereby further improve the stability of the bandgap voltage reference.

The current source includes two potential current paths between the high voltage source 101 and the low voltage source 102. These two paths will be called the reference leg and the mirror leg. The reference leg includes a number of MOS transistors that are coupled in series between the high voltage source 101 and the low voltage source 102. For example, the reference leg includes MOS transistors 111, 112, and 113. The MOS transistors include at least one PMOS transistor (e.g., PMOS transistors 111 and 112 ) and at least one NMOS transistor (e.g., NMOS transistor 113).

The one or more PMOS transistors are electrically closer in the series to the high voltage source 101 as compared to the one or more NMOS transistors. For example, PMOS transistors 111 and 112 are electrically closer in the series to the high voltage source 101 as compared to the NMOS transistor 113.

The mirror leg also includes a number of MOS transistors that are coupled in series between the high voltage source 101 and the low voltage source 102. For example, the mirror leg includes MOS transistors 121, 122, and 123. The MOS transistors include at least one PMOS transistor and at least one NMOS transistor. However, the mirror leg should include MOS transistors that match the configuration of the MOS transistors in the reference leg. For example, the mirror leg includes two PMOS transistors 121 and 122 and one NMOS transistor 123 in which the PMOS transistors are electronically closer to the high voltage source 101 than the NMOS transistor. The position of the MOS transistors 121, 122 and 123 in the mirror leg corresponds generally to the position of the MOS transistors 111, 112 and 113 in the reference leg.

The reference leg and mirror leg each include a PNP bipolar transistor 114 and 124, respectively, that are coupled to one or more voltage sources such that the device operates in the forward region. This may be accomplished by coupling the base terminal of the PNP bipolar transistor to the low voltage source 102 and by coupling the collector terminal to a voltage source that is substantially equal to or less than the low voltage provided by the low voltage source 102. For example, as illustrated in FIG. 1, the PNP bipolar transistors 114 and 124 each include a base terminal and a collector terminal that are coupled to the low voltage source 102. However, the collector terminals of the PNP bipolar transistors may also be connected to a voltage lower than that of the low voltage source 102 without affecting the performance of the circuit. The reference leg includes a series composite resistor 115 that includes at least two resistors, illustrated as resistor 116 and resistor 117. As described in the Unites States application incorporated by reference above, the size of the resistor 116 and the resistor 117 may be selected so as to provide a relatively stable reference current that is relatively independent of temperature variations and supply voltage fluctuations.

The current source described uses PNP bipolar transistors. However, it is also possible to generate the reference current using NPN bipolar transistors using the circuit 500 illustrated in FIG. 5. In this configuration, the bipolar transistors would be coupled to the high voltage source 101 rather than the low voltage source 102. More specifically, in order to guarantee that the bipolar transistor operates in the forward region, the base terminal would be connected to the high voltage source 101, while the collector terminal is coupled to a voltage source that is substantially equal to or greater than the high voltage source 101. Throughout this description and in the claims, a bipolar transistor that is coupled to voltage sources that bias the device in the forward region will be referred to as a "forward region" bipolar transistor.

Figure 5:
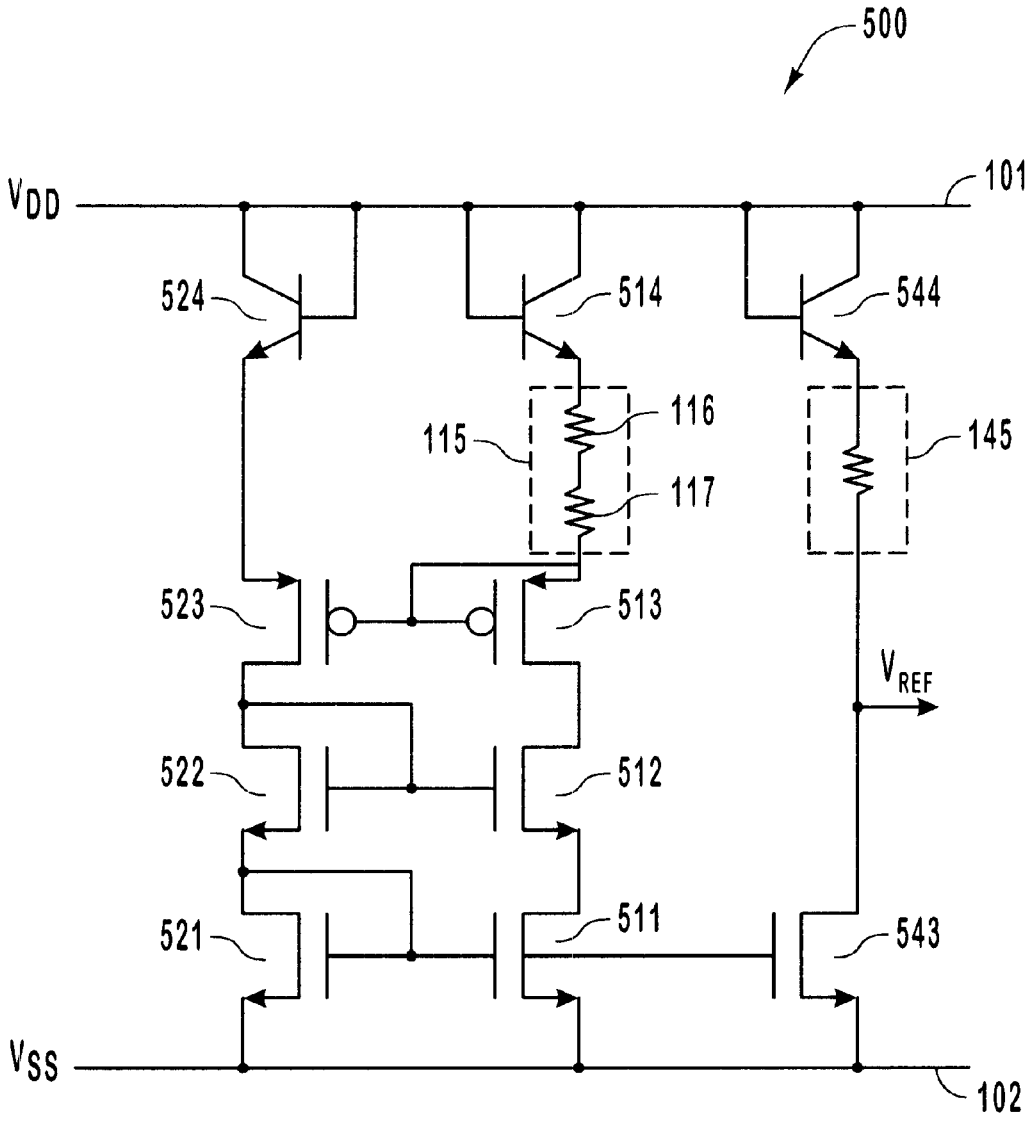
FIG. 5 illustrates a bandgap voltage reference circuit that is similar to that of FIG. 1, only with the circuit in the NPN configuration.

Also, as illustrated in FIG. 5, if an NPN bipolar transistor were being used, the PMOS transistor 111, the PMOS transistor 112, and the NMOS transistor 113 would be replace by an NMOS transistor 511, an NMOS transistor 512, and a PMOS transistor 513, respectively, with the PMOS transistor 513 being electrically closer in the series to the high voltage source 101. Similarly, the PMOS transistor 121, the PMOS transistor 122, and the NMOS transistor 123 would be replace by an NMOS transistor 521, an NMOS transistor 522, and a PMOS transistor 523, respectively, with the PMOS transistor 523 being electrically closer in the series to the high voltage source 101. The composite resistor 115 would be coupled in series between the bipolar transistor 514 and the PMOS transistor 513. This configuration illustrated in FIG. 5 in which NPN bipolar transistors are used will be referred to as the NPN configuration. The configuration illustrated in FIG. 1 in which PNP bipolar transistors are used will be referred to as the PNP configuration.

In the PNP configuration as illustrated in FIG. 1, the MOS transistors are configured such that the PMOS transistors 111, 112, 121 and 122 act to mirror current in the reference leg and the mirror leg. While there are various ways to accomplish this that will be known to those skilled in the art, one way is to use PMOS transistors with the gate terminal of PMOS transistor 111 coupled to its drain, with the gate terminal of PMOS transistor 112 coupled to its drain, with the voltage at the gate terminals of PMOS transistors 111 and 121 being shared, and with the gate terminals of PMOS transistors 112 and 122 being shared as illustrated in FIG. 1. The gate terminals of NMOS transistors 113 and 123 are also shared.

The reference current that flows through the reference leg is also mirrored to the channel regions of PMOS transistors 131 and 132 since the gates of PMOS transistors 131 are coupled to PMOS transistors 111 and 112, respectively. This results in a current flowing downward from the PMOS transistor 132 that represents the current generated by the current source. Although the reference current is relatively independent of temperature, there is still a degree of dependency on absolute temperature. Accordingly, the reference current will be referred to herein as $I_{REF}(T)$.

The bandgap voltage reference circuit 100 also includes a PNP bipolar transistor 144 which, for a given collector current, has a base-emitter voltage that is a function of absolute temperature T. The base-emitter voltage should be understood as the absolute value of the difference between the base voltage and the emitter voltage, and will be referred to as $V_{BE}(T)$. The circuit portion within the dashed box 140 also includes a composite resistor 145 having a composite resistance that varies with absolute temperature. The resistance will be referred to as $R_{C2}(T)$. The circuit produces an output bandgap voltage equal to $V_{REF}(T)$. In accordance with the present invention, $V_{REF}(T)$ may be relatively stable at a given operating temperature range by providing the composite resistor 145 as a series of two resistors that have different temperature coefficients as illustrated in FIG. 2 with resistors 146 and resistor 147. It will now be demonstrated by proof that this configuration illustrated in FIGS. 1 and 2 provides for a bandgap voltage reference $V_{REF}(T)$ that is relatively stable with temperature within a given operating temperature range.

From the above, it is apparent that the following equation 1 is an accurate expression for $V_{REF}(T)$.

$$V_{REF}(T)=V_{BE}(T)+R_{C2}(T)\cdot I_{REF}(T) \quad (1)$$

$V_{BE}(T)$ may be expressed by the following equation 2.

$$V_{BE}(T)=V_T\cdot\ln(I_C/I_S(T)) \quad (2)$$

where, $I_C$ is the collector current of the bipolar transistor, $I_S(T)$ is the saturation current of the bipolar transistor as a function of absolute temperature T, and $V_T$ is defined as the equivalent thermal voltage of the bipolar transistor which is around 25.9 millivolts at 300 degrees Kelvin and is calculated using equation 3 as follows.

$$V_T = \frac{k \cdot T \cdot nf}{q} \tag{3}$$

where, k is the Boltzmann constant which equals $1.381\times10^{-23}$ Joules/Kelvin, T is the absolute temperature in degrees Kelvin, nf is the forward emission coefficient of the bipolar transistor which is a constant that is usually very close to 1, and q is the magnitude of the electronic charge which equals $1.602\times10^{-19}$ Coulombs.

Also, the following equation 4 is a reasonably accurate expression for the bipolar transistor saturation current $I_S(T)$.

$$I_S(T) = K \cdot T^n \cdot e^{\left(-\frac{E_g}{V_T}\right)} \tag{4}$$

where,

K is a constant that depends on the process used and the device created, n, also called curvature factor, is a constant normally in the range from 2 to 4 and describes the extent of the saturation current exponential variation with temperature, and $E_g$ is the bandgap voltage that is approximately 1.16 volts for silicon and may be considered a physical constant for the purposes of this proof.

Replacing the value for $I_S(T)$ from equation 4 into equation 2 yields equation 5 as follows.

$$V_{BE}(T) = V_T \cdot \ln\left(\frac{I_C}{K \cdot T^n \cdot e^{\left(-\frac{E_g}{V_T}\right)}}\right) \tag{5}$$

Since $$\ln\left(\frac{1}{x}\right) = -\ln(x),$$

equation 5 may be rewritten as the following equation 6.

$$V_{BE}(T) = -V_T \cdot \ln\left(\frac{K \cdot T^n \cdot e^{\left(-\frac{E_g}{V_T}\right)}}{I_C}\right) \tag{6}$$

Since ln(x·y)=ln(x)+ln(y), equation 6 may be rewritten as the following equation 7.

$$V_{BE}(T) = -V_T\left(\ln\left(\frac{K \cdot T^n}{I_C}\right) + \ln\left(e^{\left(-\frac{E_g}{V_T}\right)}\right)\right) \tag{7}$$

Since $\ln(e^x)=x$, equation 7 may be rewritten as the following equation 8.

$$V_{BE}(T) = -V_T \cdot \left(\ln\left(\frac{K \cdot T^n}{I_C}\right) - \frac{E_g}{V_T}\right) \tag{8}$$

Equation 8 may be rewritten as the following equation 9.

$$V_{BE}(T) = E_g - V_T \cdot \ln\left(\frac{K \cdot T^n}{I_C}\right) \tag{9}$$

Solving for the base-emitter voltage at a reference temperature $T_0$ yields equation 10 as follows.

$$V_{BE0} = E_g - V_{T0} \cdot \ln\left(\frac{K \cdot T_0^n}{I_{C0}}\right) \tag{10}$$

where, $V_{T0}$ is the equivalent thermal voltage at the reference temperature $T_0$, and $I_{C0}$ is the collector current at the reference temperature $T_0$.

Solving for K at $T_0$ yields equation 11.

$$K = \frac{I_{C0}}{T_0^n} \cdot e^{\left(\frac{E_g - V_{BE0}}{V_{T0}}\right)} \tag{11}$$

Replacing the value of K from equation 11 into equation 9 yields equation 12.

$$V_{BE}(T) = E_g - V_T \cdot \ln\left(\frac{I_{C0}}{I_C} \cdot \frac{T^n}{T_0^n} \cdot e^{\left(\frac{E_g - V_{BE0}}{V_{T0}}\right)}\right) \tag{12}$$

A reasonably accurate expression for $I_{REF}(T)$ is defined in equation 13.

$$I_{REF}(T) = \frac{V_T \cdot \ln(M)}{R_{C1}(T)} \tag{13}$$

where,

M is the ratio of emitter area of the reference leg bipolar transistor in the current source to the emitter area of the mirror leg bipolar transistor in the current source, and $R_{C1}(T)$ is the resistance of the composite resistor in the reference leg of the current reference circuit.

Replacing $I_{REF}(T)$ from equation 13 and $V_{BE}(T)$ from equation 12 into equation 1 yields equation 14 as follows.

$$V_{REF}(T) = E_g - V_T \cdot \ln\left(\frac{I_{C0}}{I_C} \cdot \frac{T^n}{T_0^n} \cdot e^{\left(\frac{E_g - V_{BE0}}{V_{T0}}\right)}\right) + R_{C2}(T) \cdot \frac{V_T \cdot \ln(M)}{R_{C1}(T)} \tag{14}$$

A good approximation is $I_C \sim I_E = I_{REF}$ and using equation 13 in the place of $I_C$ in equation 14 yields equation 15.

$$V_{REF}(T) = E_g - V_T \cdot \ln\left(\frac{V_{T0}/R_{C10}}{V_T/R_{C1}(T)} \cdot \frac{T^n}{T_0^n} \cdot e^{\left(\frac{E_g - V_{BE0}}{V_{T0}}\right)}\right) + \tag{15}$$

-continued $$R_{C2}(T)\cdot\frac{V_T\cdot\ln(M)}{R_{C1}(T)}$$

where, $R_{C10}$ is the resistance of the current source resistor at $T_0$. The current source is designed so that the change in thermal voltage is proportional to the change in the resistance of the resistor $R_{C1}$ when the temperature is close to $T_0$. Accordingly, the following equation 16 holds true.

$$\frac{V_{T0}/R_{C10}}{V_T/R_{C1}(T)}=1 \tag{16}$$

Thus, equation 15 may reduce to the following equation 17.

$$V_{REF}(T)=E_g-V_T\cdot\ln\left(\frac{T^n}{T_0^n}\cdot e^{\left(\frac{E_g-V_{BE0}}{V_{T0}}\right)}\right)+R_{C2}(T)\cdot\frac{V_T\cdot\ln(M)}{R_{C1}(T)} \tag{17}$$

Since $\ln(y\cdot e^x)=\ln(y)+x$, equation 17 reduces to the following equation 18.

$$V_{REF}(T)=E_g-V_T\cdot\left(\ln\left(\frac{T^n}{T_0^n}\right)+\frac{E_g-V_{BE0}}{V_{T0}}\right)+R_{C2}(T)\cdot\frac{V_T\cdot\ln(M)}{R_{C1}(T)} \tag{18}$$

Furthermore, since $\ln(x^y)=y\cdot\ln(x)$, equation 18 reduced to the following equation 19.

$$V_{REF}(T)=E_g-V_T\cdot\left(n\cdot\ln\left(\frac{T}{T_0}\right)+\frac{E_g-V_{BE0}}{V_{T0}}\right)+R_{C2}(T)\cdot\frac{V_T\cdot\ln(M)}{R_{C1}(T)} \tag{19}$$

As a substitution, H is defined as the ratio $T/T_0$ which equals $V_T/V_{T0}$ since the thermal voltage is proportional to the absolute temperature. With this substitution, equation 19 reduces to the following equation 20.

$$V_{REF}(T)=E_g-V_T\cdot\left(n\cdot\ln(H)+\frac{E_g-V_{BE0}}{V_{T0}}\right)+R_{C2}(T)\cdot\frac{V_T\cdot\ln(M)}{R_{C1}(T)} \tag{20}$$

As another substitution, $X_R$ is defined as the ratio $R_{C2}(T)/R_{C1}(T)$. The resistors are assumed to be matched such that $X_R$ is constant with temperature. With this substitution, equation 20 reduces to the following equation 21.

$$V_{REF}(T)=E_g-V_T\cdot\left(n\cdot\ln(H)+\frac{E_g-V_{BE0}}{V_{T0}}\right)+X_R\cdot V_T\cdot\ln(M) \tag{21}$$

Equation 21 is equivalent to the following equation 22.

$$V_{REF}(T)=E_g-\frac{V_T}{V_{T0}}\cdot(V_{T0}\cdot n\cdot\ln(H)+E_g-V_{BE0})+X_R\cdot V_T\cdot\ln(M) \tag{22}$$

Equation 22 is equivalent to the following equation 23.

$$V_{REF}(T)=E_g-\frac{V_T}{V_{T0}}\cdot(E_g-V_{BE0}+V_{T0}\cdot n\cdot\ln(H)-X_R\cdot V_{T0}\cdot\ln(M)) \tag{23}$$

Since H is equal to $V_T/V_{T0}$ as mentioned above, equation 23 reduces to equation 24 as follows.

$$V_{REF}(T)=E_g-H\cdot(E_g-V_{BE0}+V_{T0}\cdot n\cdot\ln(H)-X_R\cdot V_{T0}\cdot\ln(M)) \tag{24}$$

Equation 24 may also be written as equation 25.

$$V_{REF}(T)=E_g-H\cdot(E_g-V_{BE0}-X_R\cdot V_{T0}\cdot\ln(M))-V_{T0}\cdot n\cdot H\cdot\ln(H) \tag{25}$$

The last term is listed as follows.

$$V_{T0}\cdot n\cdot H\cdot\ln(H)$$

As a substitution, let A be equal to $V_{T0}\cdot n$. Accordingly, the last term may be rewritten as follows.

$$A\cdot H\cdot\ln(H)$$

Using the identity represented by equation 26.

$$A\cdot(1+H\cdot(\ln(H)-1))=A+A\cdot H\cdot\ln(H)-A\cdot H \tag{26}$$

It follows that the equation 27 can be used as a substitution.

$$A\cdot H\cdot\ln(H)=A\cdot(1+H\cdot(\ln(H)-1))-A+A\cdot H \tag{27}$$

Substituting the value of $A\cdot H\cdot\ln(H)$ defined in equation 27 in for the last term of equation 25 yields the following equation 28.

$$V_{REF}(T)=E_g-H\cdot(E_g-V_{BE0}-X_R\cdot V_{T0}\cdot\ln(M))-A\cdot(1+H\cdot(\ln(H)-1))+A-A\cdot H \tag{28}$$

Reversing the substitution of $A=V_{T0}\cdot n$ yields the following equation 29.

$$V_{REF}(T)=E_g-H\cdot(E_g-V_{BE0}-X_R\cdot V_{T0}\cdot\ln(M))-V_{T0}\cdot n\cdot(1+H\cdot(\ln(H)-1))+V_{T0}\cdot n-V_{T0}\cdot n\cdot H \tag{29}$$

Equation 29 may be rewritten as the following equation 30.

$$V_{REF}(T)=(E_g+V_{T0}\cdot n)-H\cdot(E_g-V_{BE0}-X_R\cdot V_{T0}\cdot\ln(M)+V_{T0}\cdot n)-V_{T0}\cdot n\cdot(1+H\cdot(\ln(H)-1)) \tag{30}$$

Since $|1+H\cdot(\ln(H)-1)|\cong(H-1)^2$ when T is around $T_0$, due to the approximation $\ln(H)\sim H-1$ for $H\sim 1$, equation 30 reduces to the following equation 31.

$$V_{REF}(T)=(E_g+V_{T0}\cdot n)-H\cdot(E_g-V_{BE0}-X_R\cdot V_{T0}\cdot\ln(M)+V_{T0}\cdot n)-V_{T0}\cdot n\cdot(H-1)^2 \tag{31}$$

The derivative of $V_{REF}(T)$ with respect to H is defined by the following equation 32.

$$\frac{dV_{REF}}{dH} = -(E_g - V_{BEO} - X_R \cdot V_{T0} \cdot \ln(M) + V_{T0} \cdot n) - 2 \cdot V_{T0} \cdot n \cdot (H-1) \quad (32)$$

To obtain minimum temperature sensitivity of $V_{REF}(T)$ at $T \sim T_0$, it is necessary that $dV_{REF}/dH(H=1)=0$, and equation 32 reduces to the following equation 33.

$$E_g - V_{BEO} - X_R \cdot V_{T0} \cdot \ln(M) + V_{T0} \cdot n = 0 \quad (33)$$

Solving for $X_R$ yields the following equation 34.

$$X_R = \frac{E_g - V_{BEO} + V_{T0} \cdot n}{V_{T0} \cdot \ln(M)} \quad (34)$$

Assigning actual parameters to Equation 34, assume the following parameter values:

$$E_g = 1.16 \text{ V},$$

$$V_{BEO} = 0.647 \text{ V},$$

$$V_{T0} = \frac{k \cdot T_0 \cdot nf}{q} = \frac{1.381 \times 10^{-23} \cdot 300 \cdot 0.9978}{1.60 \times 10^{-19}} = 0.0258 \text{ V},$$

$$n = 3.61, \text{ and}$$

$$M = 10.$$

With these parameter values input into equation 34, $X_R$=10.19. Thus, assuming the composite resistor in the bandgap voltage reference circuit is matched with the composite resistor in the current reference circuit, the resistance in the bandgap voltage reference leg should be 10.19 times that of the current reference circuit for minimum temperature sensitivity at T=300K.

Substituting these values into equation 31 reveals that the voltage reference $V_{REF}(T)$ equal $1.253-0.0933 \cdot (H-1)^2$ Volts. Thus, as H is close to one when the actual operating temperature is close to the target operating temperature, a relatively stable reference voltage of 1.253 V may be obtained by using composite resistors in the bandgap voltage reference circuit.

Although the above proof illustrates how a bandgap voltage reference may be obtained that is substantially stable with temperature using a series composite resistor that is matched to the series composite resistor in the reference current circuit, these composite resistors are not required to be matched for a benefit to be derived from the present invention.

Figure 3:
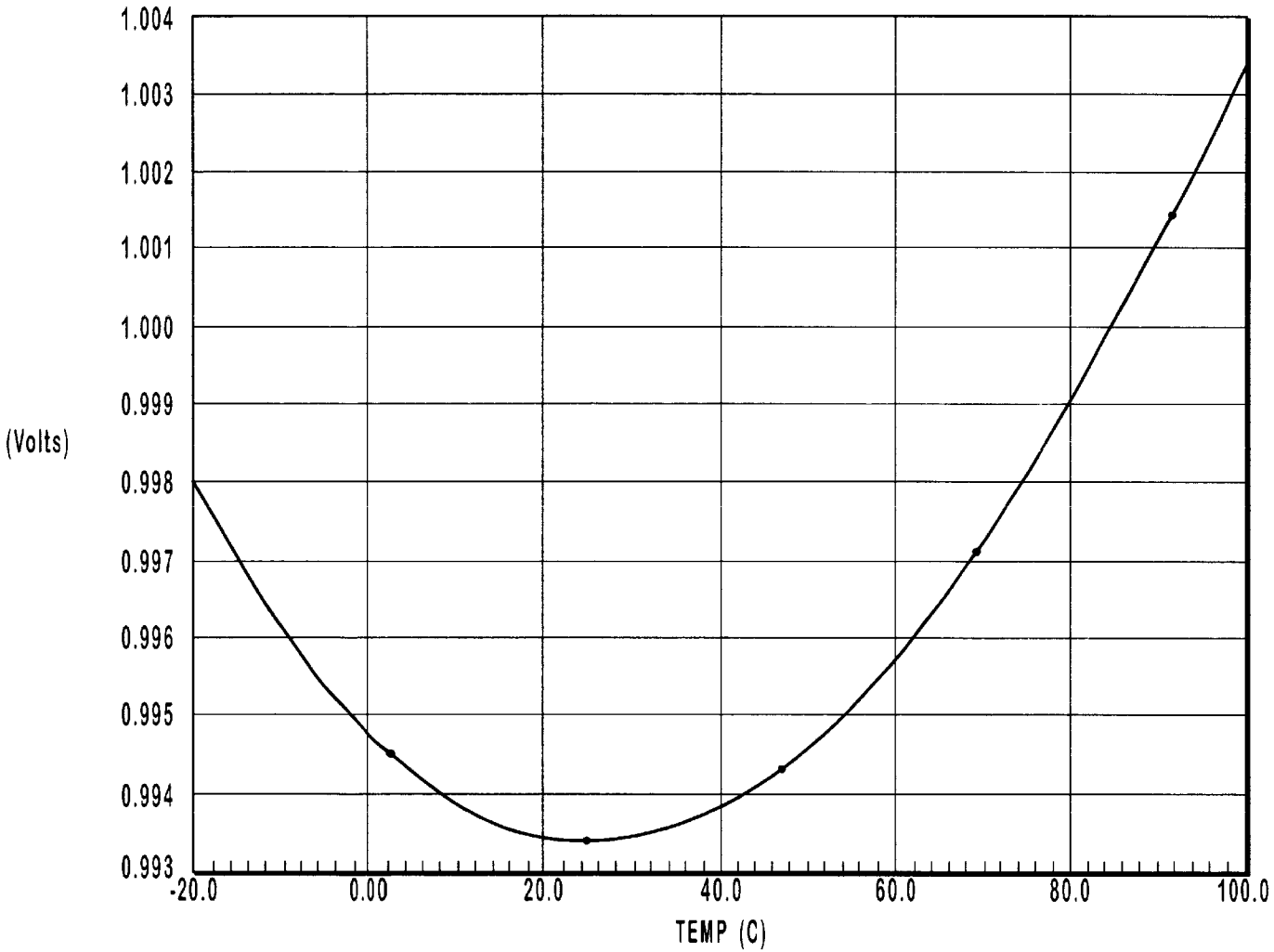
FIG. 3 illustrates simulation results in which an upside curvature in temperature dependency is observed.

For example, SPICE simulation results show that by allowing more of the higher temperature coefficient in the composite resistor (e.g., using a pure n-well resistor), a lower bandgap voltage reference of approximately 1.00 V may be obtained that has an upside curvature when plotted with temperature on the x-axis. These simulation results are illustrated in FIG. 3 and are based on resistor 145 being a pure n-well resistor with a particular resistance value. That resistance value is process dependent and can either be determined mathematically, or optimized by simulation or experimental methods.

In addition, other SPICE simulation results show that by having a particular composite resistor temperature coefficient of the bandgap voltage reference leg different from the composite resistor temperature coefficient of the current reference circuit, the temperature coefficient of the voltage reference circuit can be theoretically reduced to the range of 1 ppm/° C. The actual optimization will depend on the target temperature and on the individual components of the composite resistor.

Figure 4:
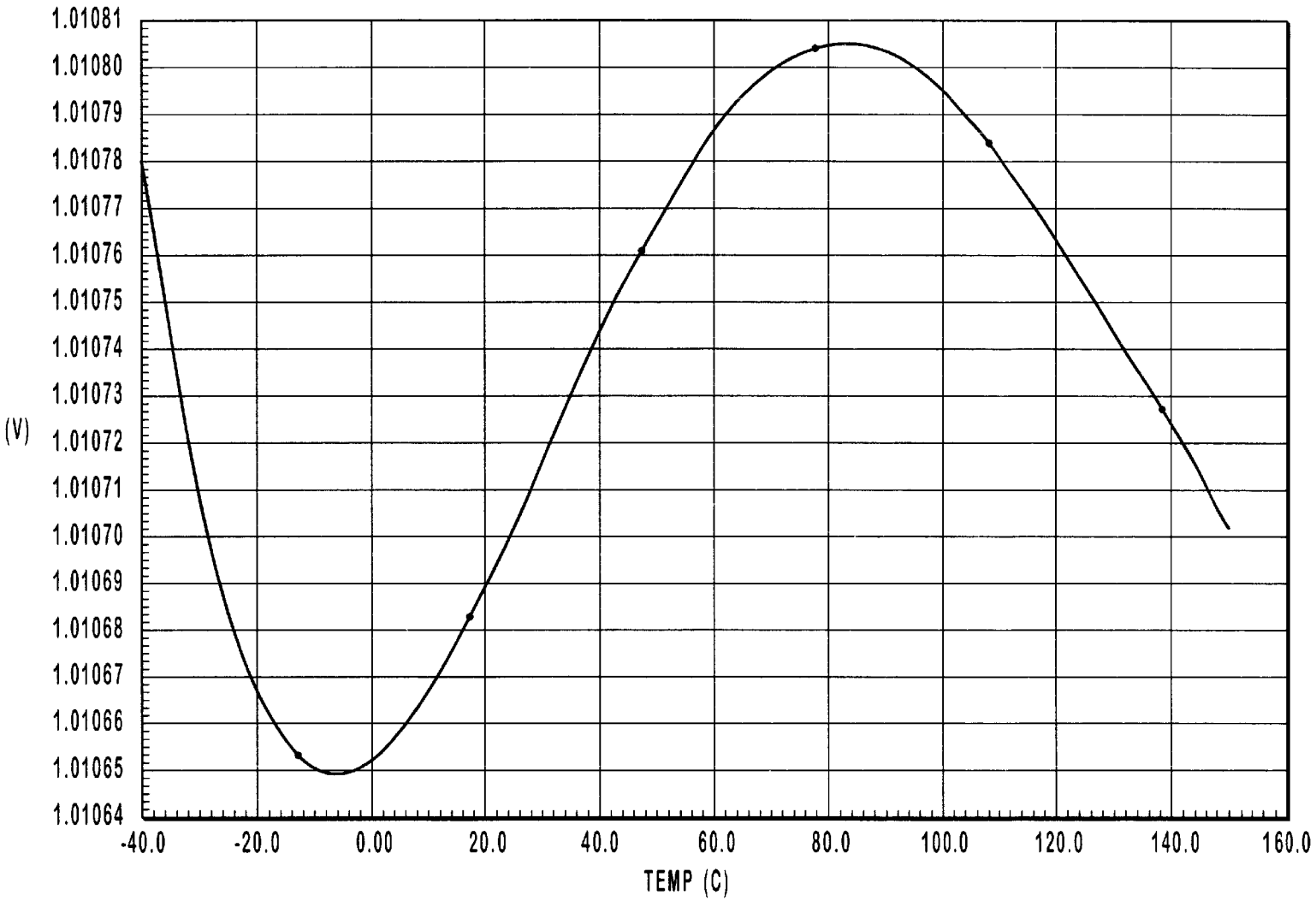
FIG. 4 illustrates simulation results in which there is curvature correction.

In any case, the purpose is to have a different equation for $V_{REF}(T)$ where the coefficients of both the first-order term (H) and second-order term ($(H-1)^2$) are made close to zero. That kind of technique is normally referred to as the "curvature correction" of the bandgap voltage reference, where the curvature is a parabola caused by the second-order term. What remains after the curvature correction is a fixed voltage and a third-order term in $(H-1)^3$ which was not considered in the approximations used to derive equation 34, but whose effects can be appreciated at the simulation. The third-order term actually exists in all bandgap voltage references but usually has a relatively small coefficient which makes its influence insignificant when compared to the second-order term for temperatures around $T_0$. As a matching with the current reference composite resistor no longer exists, the curvature correction can be achieved with other composite resistors at the voltage reference leg that are not necessarily of the same type. Simulation results that illustrate this curvature correction are shown in FIG. 4 and are based in a particular composite resistor in the place of resistor 145. That composite resistor is process dependent and its components can either be determined mathematically, or optimized by simulation or experimental methods.

Accordingly, a bandgap voltage reference circuit is described that produces a voltage reference that is relatively stable without requiring an operational amplifier. Also, since composite resistors are used to obtain the required temperature coefficients, standard CMOS processes may be used to construct the component resistors. Accordingly, no process customization need be performed and thus the cost of manufacturing the bandgap voltage reference may be kept low. In addition, a bandgap voltage reference circuit has been described in which there are only two MOS transistors, a bipolar transistor, and a composite resistor that are added to a current reference. In this sense, the incremental chip space needed to create a bandgap voltage reference circuit out from an already useful circuit is minimal.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A bandgap voltage reference circuit for providing a bandgap voltage reference that does not require an operational amplifier, the bandgap voltage reference circuit comprising the following:

a first voltage source, configured to supply a first voltage during operation;

a second voltage source, configured to supply a second voltage during operation that is lower than the first voltage;

a current source coupled between the high voltage source and the low voltage source;

a forward region bipolar transistor that is coupled to a given voltage source, the given voltage source being either the high voltage source or the low voltage source, wherein the bipolar transistor is configured to pass current between the current source and the given voltage source;

a composite resistor coupled between the current source and the bipolar transistor, the composite resistor comprising:

a first resistor fabricated using a first group of one or more steps of a process; and a second resistor fabricated using a second group of one or more steps in the process.

2. A bandgap voltage reference circuit in accordance with claim 1, wherein the composite resistor is a first composite resistor and the first and second resistor are coupled in series between the current source and the bipolar transistor, the current source comprising a reference leg that is coupled between the high voltage source and the low voltage source and that comprises a second composite resistor that includes a third resistor and a fourth resistor coupled in series between the high voltage source and the low voltage source.

3. A bandgap voltage reference circuit in accordance with claim 2, wherein the third resistor is fabricated using the first group of one or more steps, wherein the fourth resistor is fabricated using the second group of one or more steps.

4. A bandgap voltage reference circuit in accordance with claim 3, wherein the ratio of the resistance of the first resistor to the third resistor is approximately equal to the ratio of the resistance of the second resistor to the fourth resistor.

5. A bandgap voltage reference circuit in accordance with claim 2, wherein the first resistor and the second resistor are structured such that a first-order temperature variation of the voltage reference generated by the bandgap voltage reference circuit is substantially eliminated.

6. A bandgap voltage reference circuit in accordance with claim 2, wherein the first resistor and the second resistor are structured such that a first-order temperature variation and a second-order temperature variation of the voltage reference generated by the bandgap voltage reference circuit are substantially eliminated.

7. A bandgap voltage reference circuit in accordance with claim 1, wherein the current source comprises the following:

A) a reference leg coupled between the high voltage source and the low voltage source, the reference leg comprising the following:

i) a plurality of MOS transistors coupled in series between the high voltage source and the low voltage source, the plurality of MOS transistors comprising:

a) a group of at least one PMOS transistor that is electrically closer in the series to the high voltage source; and b) a group of at least one NMOS transistor that is electrically closer in the series to the low voltage source; and ii) a series composite resistor comprising at least a first series resistor and a second series resistor that are coupled in series with each other between the first and second voltage sources, wherein the series composite resistor is disposed on the side of the plurality of MOS transistors that is electrically closer in series to the given voltage source between the high and low voltage sources, wherein the first series resistor and the second series resistor are fabricated differently; and B) a mirror leg coupled between the high voltage source and the low voltage source, the mirror leg coupled with the reference leg so that current flowing through the reference leg is mirrored in the mirror leg.

8. A bandgap voltage reference in accordance with claim 7, wherein the current source further comprises the following:

C) a MOS transistor sharing a gate voltage with one of the plurality of MOS transistors in the reference leg, the MOS transistor coupled between the high and low voltage sources, wherein the current flow from the terminal of the MOS transistor that is proximate the composite resistor comprises the current generated by the current source.

9. A bandgap voltage reference in accordance with claim 8, wherein the bipolar transistor is a first forward region bipolar transistor, wherein the reference leg further comprises a second forward region bipolar transistor coupled in series between the high and low voltage sources, wherein the forward region bipolar transistors are disposed between the series composite resistor and the given voltage source.

10. A bandgap voltage reference circuit in accordance with claim 8, wherein the series composite resistor is a first series composite resistor, wherein the composite resistor is a second series composite resistor, the first and second resistors in the second series composite resistor being coupled in series between the current source and the first bipolar transistor, the first series resistor comprising a third resistor and a fourth resistor coupled in series between a high voltage source and a low voltage source.

11. A bandgap voltage reference circuit in accordance with claim 10, wherein the third resistor is fabricated using the first group of one or more steps, wherein the fourth resistor is fabricated using the second group of one or more steps.

12. A bandgap voltage reference circuit in accordance with claim 11, wherein the ratio of the resistance of the first resistor to the third resistor is approximately equal to the ratio of the resistance of the second resistor to the fourth resistor.

13. A bandgap voltage reference circuit in accordance with claim 10, wherein the first resistor and the second resistor are structured such that a first-order temperature variation of the voltage reference generated by the bandgap voltage reference circuit is substantially eliminated.

14. A bandgap voltage reference circuit in accordance with claim 10, wherein the first resistor and the second resistor are structured such that a first-order temperature variation and a second-order temperature variation of the voltage reference generated by the bandgap voltage reference circuit are substantially eliminated.

* * * * *

UNITED STATES PATENT AND TRADEMARK OFFICE

CERTIFICATE OF CORRECTION

PATENT NO. : 6,342,781 B1
DATED : January 29, 2002
INVENTOR(S) : J. Marcos Laraia It is certified that error appears in the above-identified patent and that said Letters Patent is hereby corrected as shown below:

Column 5,
Line 30, after "in the" change "Unites" to -- United --
Line 53, before "being used," change "were" to -- was --
Line 55, before "by an" change "replace" to -- replaced --
Line 60, after "would be" change "replace" to -- replaced --

Signed and Sealed this

Twenty-sixth Day of November, 2002

*Attest:*

*Attesting Officer*

JAMES E. ROGAN
*Director of the United States Patent and Trademark Office*